US005792600A

United States Patent [19]

Nagami

[11] Patent Number: 5,792,600

[45] Date of Patent: Aug. 11, 1998

[54] SILVER HALIDE PHOTOGRAPHIC LIGHT SENSITIVE MATERIAL

[75] Inventor: Ken Nagami, Hino, Japan

[73] Assignee: Konica Corporation, Japan

[21] Appl. No.: 972,926

[22] Filed: Nov. 18, 1997

[30] Foreign Application Priority Data

Nov. 22, 1996 [JP] Japan ..... 8-312018

[51] Int. Cl.[6] ..... G03C 1/34; G03C 1/31; G03C 1/76

[52] U.S. Cl. ..... 430/539; 430/567; 430/608; 430/621; 430/631; 430/642; 430/950; 430/961; 430/523

[58] Field of Search ..... 430/950, 961, 430/631, 608, 539, 220, 621, 642, 567, 523

[56] References Cited

U.S. PATENT DOCUMENTS

| | | | |
|---|---|---|---|
| 4,001,022 | 1/1977 | Sahyun | 430/631 |
| 5,478,709 | 12/1995 | Vandenabeele | 430/523 |
| 5,674,675 | 10/1997 | Inoue | 430/631 |

*Primary Examiner*—Richard L. Schilling

*Attorney, Agent, or Firm*—Jordan B. Bierman; Bierman, Muserlian and Lucas

[57] ABSTRACT

Disclosed is a silver halide photographic light sensitive material comprising a support and provided thereon, a light sensitive silver halide emulsion layer and a non-light sensitive hydrophilic binder layer, wherein at least one of the light sensitive silver halide emulsion layer and the non-light sensitive hydrophilic binder layer contains tabular silica particles covered with a hardened gelatin layer.

9 Claims, No Drawings

SILVER HALIDE PHOTOGRAPHIC LIGHT SENSITIVE MATERIAL

FIELD OF THE INVENTION

The invention relates to a silver halide photographic light sensitive material and particularly to a silver halide photographic light sensitive material having high sensitivity, excellent anti-scratching property and less devitrification.

BACKGROUND OF THE INVENTION

Currently, electronic techniques have rapidly progressed, and access time of image forming has been greatly shortened employing such electronic techniques. Also in processing a silver halide photographic light sensitive material, rapid processing is sought. Silver halide grains with high sensitivity are required, and in response to such requirements, tabular silver halide grains are often employed. Tabular silver halide grains having a large projected area increase the area receiving light per grain, and adsorb much of a sensitizing dye which brings about higher spectral sensitivity. Tabular silver halide grains in a gelatin binder of a silver halide photographic light sensitive material are detailed in U.S. Pat. Nos. 4,386,156, 4,399,215, 4,414,304 and 4,425,425.

In order to carry out rapid processing, a technique to reduce the amount of gelatin carrying silver halide grains is required whereby development speed, fixing speed, washing speed and drying speed are each increased. However, when the gelatin amount is reduced, there is a problem in that silver halide grains with high sensitivity are susceptible to physical damage. In order to overcome the problem, improvements of silver halide grain preparation have been attempted, but a method of obtaining silver halide grains with high sensitivity, low fog and excellent pressure resistance has not yet been found.

In order to improve the pressure resistance, a method of adding latex, a soft compound working as a buffering agent is known as disclosed in JP-B 53-28086 and Research Disclosure, Volume 195 (July, 1980), Item 19551. In JP-A 2-135335 is disclosed a technique of employing tabular silver halide grains and latex in combination. However, in these techniques, when the gelatin amount is reduced to obtain rapid processing and a large amount of latex is added, pressure resistance is enhanced, but physical property of coated film layers is deteriorated, for example, sticking occurs. Satisfactory results are not obtained by these techniques.

As a technique for solving the above described problems, in JP-A 7-64232 is disclosed a technique of adding tabular silica particles to an emulsion layer to improve the pressure resistance of the emulsion layer. This technique certainly minimizes deterioration of physical property of the emulsion layer, but the addition of the silica in an amount sufficient to show the effect of this technique tends to cause devitrification. In order to secure the rapid processing recently required, the gelatin amount tends to be reduced. However, the reduction of the gelatin amount increases the tabular silica particle content compared to the gelatin content, resulting in devitrification, which is commercially problematic.

SUMMARY OF THE INVENTION

Accordingly, an object of the invention is to provide a silver halide photographic light sensitive material having high sensitivity, excellent pressure resistance and less devitrification.

DETAILED DESCRIPTION OF THE INVENTION

The above object of the invention have been attained by the following:

1. a silver halide photographic light sensitive material comprising a support and provided thereon, a silver halide emulsion layer and a non-light sensitive hydrophilic binder layer, wherein at least one of the silver halide emulsion layer and the non-light sensitive hydrophilic binder layer contains gelatin-covered tabular silica particles, 2. the silver halide photographic light sensitive material of item 1 above, wherein the total gelatin content of the layer containing the silica particles is 0.2 to 1.5 g/m$^2$, 3. the silver halide photographic light sensitive material of item 1 or 2 above, wherein the silica particles are contained in a silver halide emulsion layer comprising silver halide grains having an aspect ratio of 3 to 15, or 4. a silver halide photographic light sensitive material comprising a support and provided thereon, a light sensitive silver halide emulsion layer and a non-light sensitive hydrophilic binder layer, wherein at least one of the light sensitive silver halide emulsion layer and the non-light sensitive hydrophilic binder layer contains tabular silica particles covered with a hardened gelatin, 5. the silver halide photographic light sensitive material of item 4 above, wherein the tabular silica particles have an average particle size of 2 to 300 nm and an aspect ratio of 2 to 100, and the tabular silica particle content of the total silica particles is 50 weight % or more, 6. the silver halide photographic light sensitive material of item 4 above, wherein each of the light sensitive silver halide emulsion layer and the non-light sensitive hydrophilic binder layer contains gelatin, 7. The silver halide photographic light sensitive material of item 6 above,, wherein the total gelatin content of a layer containing the tabular silica particles is 0.2 to 1.5 g/m$^2$, and the tabular silica particle content (by weight) of said layer is 0.05 to 1.0 based on the total gelatin content, 8. the silver halide photographic light sensitive material of item 4 above, wherein the light sensitive silver halide emulsion layer contains the tabular silica particles, 9. the silver halide photographic light sensitive material of item 8 above, wherein the light sensitive silver halide emulsion layer contains tabular silver halide grains having an aspect ratio of 3 to 15, 10. the silver halide photographic light sensitive material of item 4 above, wherein the hardened gelatin is formed by hardening gelatin with a hardener, 11. a silver halide photographic light sensitive material comprising a support and provided thereon, a light sensitive silver halide emulsion layer and a non-light sensitive hydrophilic binder layer, each layer containing gelatin, wherein at least one of the light sensitive silver halide emulsion layer and the non-light sensitive hydrophilic binder layer contains tabular silica particles covered with hardened gelatin, the tabular silica particles having an average particle size of 1 to 300 nm and an aspect ratio of 2 to 100, and the tabular silica particle content of the total silica particles being 50 weight % or more, and the total gelatin content of a layer containing the tabular silica particles is 0.2 to 1.5 g/m$^2$, and the tabular silica particle content (by weight) of the layer containing the tabular silica particles is 0.05 to 1.0 based on the total gelatin content, or 12. a silver halide photographic light sensitive material comprising a support and provided thereon, a light sensitive silver halide emulsion layer containing gelatin and tabular silica particles covered with hardened gelatin, the tabular silica particles having an average particle size of 1 to 300 nm and an aspect ratio of 2 to 100, and the tabular silica particle content of the total silica particles being 50 weight % or more, wherein the total gelatin content of the emulsion layer is 0.2 to 1.5 g/m$^2$, and the tabular silica particle content of the emulsion layer is 0.05 to 1.0 based on the total gelatin content.

Next, the invention will be explained in detail.

The tabular gelatin-covered silica particles used in the invention is characterized in that the silica particles are covered with gelatin hardened with a cross-linking agent. Each of the silica particles may be covered with a crosslinked gelatin, and a group comprised of several silica particles may be covered with gelatin to form crosslinked gelatin-covered silica particles. That is, the present invention, which employs tabular silica particles covered with a hardened gelatin, is distinguished from a conventional technique which employs simple tabular silica particles. The layer thickness of the hardened gelatin with which the tabular silica particles are covered is in the range of 1 to 500 nm. After the surface of the tabular silica particles are treated with a silane coupling agent, an aluminate compound or a titanium compound disclosed in JP-A 4-257489 and 6-95300 in order to enhance affinity to gelatin, the silica particles may be covered with gelatin. The average particle size of the tabular silica particles used in the invention is preferably 2 to 300 nm, and more preferably 5 to 200 nm in that transparency of silver halide photographic light sensitive material is secured.

The average particle size of the tabular silica particles is measured with a transmission electron microscope according to a conventional method.

The silica used in the invention implies a silicate in a layer form containing an alkali metal, an alkali earth metal or aluminum, and includes kaolin minarals, mica clay minerals and smectites. The kaolin minarals include kaolinite, dickite, nacrite, halloysite, and serpentinite. The mica clay minerals include pyrophyllite, talc, muscovite, swelling synthetic fluorinated mica, sericite, and chlorite. The smectites include smectites, vermiculite, and swelling synthetic fluorinated vermiculite.

Of these, the preferable is smectites having swelling property and ion exchange ability. The smectites include natural and synthetic smectites. The natural smectites include montmorillonite and beidelite which is obtained as clay called bentonite or acid clay. Examples using these in a non-light sensitive hydrophilic colloid layer as an antistatic agent are described in JP-A 60-202438 and 60-239747. The synthetic smectites are preferably employed in that transparency is excellent. The synthetic smectites include smectites containing fluorine which enhance heat resistance. Examples of the synthetic smectites include Lucentite SWN and SWF produced by Cope Chemical Co., Ltd.

The aspect ratio of the tabular silica particles used in the invention is preferably 2 to 100, and more preferably 2 to 50. The aspect ratio herein referred to as implies a ratio of a diameter of a circle having the same area as the projected tabular silica particles to the distance (thickness of the tabular silica particles) between the two parallel major faces of the tabular silica particles. The tabular silica particles in the invention have a thickness of not more than 1.0 μm, preferably not more than 0.5 μm, and more preferably 0.1 to 0.5 μm. The tabular silica particles have monodispersed silica particles having, in its particle size distribution, a variation coefficient (represented by S/D×100, S representing standard deviation of a circle converted diameter of and D representing the diameter, when the silica particle projected area is approximated to a circle) of preferably not more than 30%, and more preferably not more than 20%. In the invention, at least one of the light sensitive silver halide emulsion layer and the non-light sensitive hydrophilic binder layer contains tabular silica particles having an aspect ratio of preferably 2 to 100, and more preferably 2 to 50 in an amount of 50 weight % or more based on the total silica particle content.

The tabular silica particles used in the invention are generally used in a form of an aqueous dispersion. The dispersion is preferably prepared by adding little by little the tabular silica particles to a specific amount of water while vigorously stirring with a high speed stirrer such having a sufficient shearing force as a homogenizer or an impeller. On preparing of the dispersion, a dispersing agent is optionally added. The dispersing agent includes a polyphosphate such as sodium pyrophosphate or sodium hexametaphosphate, a polyhydric alcohol such as trimethylol propane, trimethylol ethane or trimethylol methane, and a non-ionic polymeric compound such as polyethylene glycol alkyl ester.

When the tabular silica particles are covered with a hardened gelatin layer, a hardener capable of hardening gelatin can be used. The hardener is preferably an aldehyde, a triazine, a vinylsulfone or a carboxy active hardener as disclosed in JP-A 63-61243.

Gelatin used for covering the tabular silica particles may be an alkali-processed gelatin, an acid-processed gelatin or a phthalated gelatin. The calcium ion content of the gelatin is preferably 0 to 4000 ppm in view of dispersion stability.

The preparation method of the tabular silica particles covered with hardened gelatin will be described below. An aqueous gelatin solution and an aqueous tabular silica dispersion are mixed, and a gelatin hardener is then little by little added to the mixture dispersion keeping at 30° to 80° C. while stirring with a high speed stirrer having sufficient shearing force such as a homogenizer or an impeller. After completion of the addition, the resulting mixture was stirred and dispersed for additional 1 to 72 hours. A polyphosphate such as sodium pyrophosphate, sodium hexametaphosphate or sodium tripolyphosphate, a polyhydric alcohol such as sorbitol, trimethylol propane, trimethylol ethane or trimethylol methane, or a non-ionic polymeric compound such as polyethylene glycol alkyl ester is optionally added to the dispersion in order to prevent coagulation.

Prefeferable preparing method of dispersions containing tabular silica particles covered with hardened gelatin (gelatin-covered tabular silica particles) B-1 to B-6 used in the invention will be described below.

Preparation of Dispersion B-1

A 260 g alkali-processed gelatin was dissolved im 8750 cc water. The resulting solution was kept at 40° C. and added with 1000 g of Lucentite SWN (a 30 wt % aqueous dispersion of tabular silica particles with an average particle size of 140 nm) produced by Cope Chemical Co., Ltd. To the dispersion were dropwise added 220 cc of a 3.7% formalin solution in 1 minute while stirring with a homogenious mixer, and further stirred for additional 5 hours. The resulting dispersion was filtered out with a filter of a 3 μm mesh to remove aggregates.

Thus, dispersion B-1 was obtained in which the tabular silica particles had an average particle size of 200 nm, and 63 weight % of the total tabular silica particles had an aspect ratio of 2 to 100.

Preparation of Dispersion B-2

A 260 g alkali-processed gelatin was dissolved in 7650 cc water. The resulting solution was mixed with a dispersion obtained by adding 3.0 g of 3-glycidoxytrimethoxysilane to 1000 g of Lucentite SWN above described and then stirring at 50° C. for 1 hour. To the mixture dispersion were dropwise added 220 cc of a 3.7% formalin solution in 1 minute while stirring with a homogeneous mixer, further stirred at 50° C. for additional 10 hours, and filtered out with a filter of a 3 μm mesh to remove aggregates. Thus, dispersion B-2 was obtained in which the tabular silica particles had an average particle size of 0.16 μm, and 71 weight % of the total tabular silica particles had an aspect ratio of 2 to 100.

Preparation of Dispersion B-3

Dispersion B-3 was prepared in the same manner as in Synthesis Example 2, except that the following titanium compound (TI) was used instead of the silane coupling agent.

In the thus obtained dispersion B-3, the tabular silica particles had an average particle size of 190 nm, and 68 weight % of the total tabular silica particles had an aspect ratio of 2 to 100.

Titanium Compound (TI)

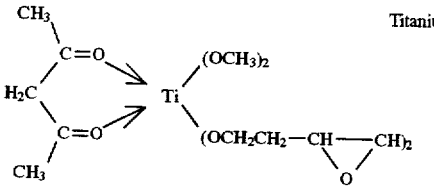

Preparation of Dispersion B-4

Dispersion B-4 was prepared in the same manner as in Synthesis Example 1, except that the following hardener (RH) was used instead of the formaline solution.

In the thus obtained dispersion B-4, the tabular silica particles had an average particle size of 200 nm, and 64 weight % of the total tabular silica particles had an aspect ratio of 2 to 100.

Compound (RH)

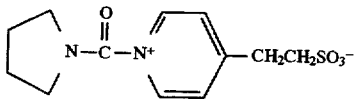

Preparation of Dispersion B-5

Dispersion B-5 was prepared in the same manner as in Synthesis Example 1, except that an acid-processed gelatin was used instead of the alkali-processed gelatin.

In the thus obtained dispersion B-5, the tabular silica particles had an average particle size of 170 nm, and 71 weight % of the total tabular silica particles had an aspect ratio of 2 to 100.

Preparation of Dispersion B-6

Dispersion B-6 was prepared in the same manner as in Synthesis Example 1, except that Lucentite SWF (a 30 wt % aqueous dispersion of tabular silica particles with an average particle size of 180 nm) produced by Cope Chemical Co., Ltd. was used instead of Rucentite SWN.

In the thus obtained dispersion B-6, the tabular silica particles had an average particle size of 190 nm, and 70 weight % of the total tabular silica particles had an aspect ratio of 2 to 100.

The average particle size of the gelatin-covered tabular silica particles in the above dispersion is measured as follows:

The dispersion containing gelatin-covered tabular silica particles is added to an aqueous 0.1 weight % actinase solution, stirred at 45° C. for 3 hours, and centrifuge filtered with a centrifuge filter tube produced by Nihon Millipore Co., Ltd. The resulting filtrate is dispersed with ultrasonic waves, dropped on a filter comprised of a carbon membrane provided on a copper mesh, and rotated at high speed to evaporate the water. Thus, tabular silica particles, which are not covered with gelatin, are obtained. The average particle size of the resulting tabular silica particles is measured with a transmission electron microscope.

In the invention, the silver halide emulsion layer or the non-light sensitive hydrophilic binder layer contains a hydrophilic colloid compound such as a natural or synthetic hydrophilic polymer, e.g., gelatin, dextrane, dextrin, polyacrylamide, and preferably contains gelatin.

The light sensitive silver halide emulsion layer in the invention contains silver halide grains and, as a dispersion medium thereof, a protective colloid.

The silver halide grains used in the invention will be explained.

The silver halide grains used in the invention are not specifically limited, but are preferably silver halide grains with an aspect ratio of 3 to 15. Grains with an aspect ratio of less than 3 to is disadvantageous in sensitivity, and grains exceeding an aspect ratio of 15 is disadvantageous in anti-scratching property.

The silver halide grains used in the invention may be silver bromide, silver chloride, silver bromoiodide, silver chloroiodide, silver iodochloride, or silver chloroiodobromide. The average silver iodide content of the silver halide grains is preferably 1.0 mol % or less, and more preferably 0.5 mol %.

In the invention, the halide composition of the silver halide grains may be any, but the silver chloride content is preferably 50 mol % or more, and more preferably 70 mol % or more.

The tabular silver halide grains used in the invention can be prepared according to a method dosclosed in U.S. Pat. No. 5,320,938. Nuclei are preferably formed at a low pCl in the presence of an iodode ion under conditions that a (100) face is likely to form. After the nuclei formation, Ostwald ripening and/or growth proceed to form tabular silver halide grains. The tabular silver halide grains used in the invention may be a so-called halogen conversion type. The halogen conversion amount is preferably 0.2 to 2.0 mol % based on the silver amount. The conversion stage may be during or after physical ripening.

Further, at least one metal ion selected from a cadmium salt, a zinc salt, a lead salt, a thallium salt, iridium salt (an iridium complex), a rhodium salt (a rhodium complex), a ruthenium salt (a ruthenium complex), an osminium salt (an osminium complex) and an iron salt (an iron complex) can be added to silver halide grains during formation and/or growth of the grains to incorporate this metal in the inner portion and/or on the surface of the grains.

The silver halide solvent is preferably added before the desalting spep in order to accelerate development. For example, thiocyanate compounds such as potassium thiocyanate, sodium thiocyanate, and ammonium thiocyanate are preferably added in an amount of $1\times10^{-3}$ to $3\times10^{-2}$ mol per mol of silver.

In the invention, gelatin is preferable as the dispersion medium of the silver halide grains, and gelatin includes an alkali-processed gelatin, an acid-processewd gelatin, a low molecular weight gelatin (a molecular weight of 20,000 to 100,000) and modified gelatin such as phthalated gelatin. The hydrophilic colloid other than these can be used. The colloid includes those described in Research Disclosure (hereinafter referred to as RD), 176, item No. 17643 (1978/12).

In the invention, the total gelatin content of a layer containing the tabular silica particles with hardened gelatin layer is preferably 0.2 to 1.5 g/m$^2$, and the tabular silica particle content (by weight) of said layer is preferably 0.05 to 1.0, and more preferably 0.1 to 0.7, based on the total gelatin content. The total gelatin content herein referred to implies the sum total of an amount of gelatin used as the hydrophilic colloid compound or as the dispersion medium of silver halide grains and an amount of gelatin used for covering the tabular silica particles.

In the silver halide emulsion used in the invention undesirable soluble salts may or may not be removed after the silver halide grain growth. The removal of the soluble salts can be carried out by the method described in RD No. 17643, Item II.

The silver halide grains can be chemically sensitized. The chemical ripening or chemical sensitization can be carried out without any limitation of conditions such as pH, pAg, temperature and time, and can be carried out under conventional conditions. Chemical sensitization is carried out according to a sulfur sensitization using a sulfur-containing compound capable of reacting with a silver ion or an active gelatin, selenium sensitization using a selenium compound, tellurium sensitization using a tellurium compound, reduction sensitization using a reducing compound, noble metal sensitization using gold or another noble metal compound or their combination. Of these, selenium sensitization, tellurium sensitization or reduction sensitization is preferably used, and selenium sensitization is especially preferable.

Selenium sensitization is disclosed in U.S. Pat. No. 1,574,944, 1,602,592, and 1,623,499and JP-A 60-150046, 4-25832, 4-109240 and 4-147250.

The useful selenium sensitizer includes colloidal selenium metal, isoselenocyanates (for example, allyl isoselenocyanate), selenoureas (for example, N,N-dimethylselenourea, N,N,N'-triethylselenourea, N,N,N'-trimethyl-N'-heptafluoroselenourea, N,N,N'-trimethyl-N'-heptafluoropropylcarbonylselenourea, N,N,N'-trimethyl-N'-4-nitrophenylcarbonylselenourea), selenoketones (for example, selenoacetone, selenoacetophenone), selenoamides (for example, selenoacetoamide, N,N-dimethylselenobenzamide), selenophosphates (for example, tri-p-triselenophosphate), selenides (for example, diethylselenide, diethyldiselenide, triphenylphosphinselenide). The especially preferable selenium sensitizer is selenoureas, selenophosphates or selenides.

The addition amount of the selenium compound depends upon kinds of compounds used, kinds of a silver halide emulsion used or chemical ripening conditions, but is in the range of $1\times10^{-8}$ to $1\times10^{-4}$ mol per mol of silver halide.

The selenium compound is added with a solution in which the selenium compound is dissolved in water or an organic solvent such as methanol, ethanol or ethyl acetate or its mixture solvent depending on nature of the selenium compound, a gelatin solution containing the selenium compound or a method disclosed in JP-A4-140739, that is, a dispersion solution containing an organic solvent soluble polymer and the selenium compound.

The silver halide grains in the invention may be spectrally sensitized with cyanine dyes or other sensitizing dyes. The sensitizing dyes may be used singly or in combination. A combination of sensitizing dyes is often used for the purpose of super sensitizing.

When the silver halide photographic light sensitive material in the invention is used for an X-ray film in which both surfaces of the support are coated with an emulsion, a crossing light shielding layer is preferably provided in order to improve an image sharpness. The crossing light shielding layer contains a solid dispersion of dyes in order to absorb the crossing light. Such dyes are not specifically limited, as long as they are dyes which are soluble in an alkaline solution of pH 9 or more and sparingly soluble in a solution of pH 7 or less, but dyes represented by formula (I) disclosed in JP-A 6-308670 are preferably used in view of decoloring property.

To the emulsion used in the present invention, various photographic additives can be added during a physical ripening step or before or after a chemical ripening step.

As compounds used in such a procedure, for example, various compounds described in Research Disclosure Nos. 17643, 18716 (November, 1979) and 308119 (December, 1989) are cited. Kind of compound and place described in these three RDs are illustrated as follows:

| | RD-17643 | | RD-18716 | | RD-308119 | |
|---|---|---|---|---|---|---|
| Additive | Page | Classification | Page | Classification | Page | Classification |
| Chemical sensitizer | 23 | III | 648 upper right | | 996 | III |
| Sensitizing dye | 23 | IV | 648–649 | | 996–8 | IV |
| Desensitizing dye | 23 | IV | | | 998 | IVB |
| Pigment | 25–26 | VIII | 649–650 | | 1003 | VIII |
| Development accelerator | 29 | XXI | 648 upper right | | | |
| Anti-foggant and stabilizer | 24 | IV | 649 upper right | | 1006–7 | VI |
| Brightening agent | 24 | V | | | 998 | V |
| Hardener | 26 | X | 651 left | | 1004–5 | X |
| Surfactant | 26–27 | XI | 650 right | | 1005–6 | XI |
| Plasticizer | 27 | XXI | 650 right | | 1006 | XXI |
| Lubricant | 27 | XXI | | | | |
| Matting agent | 28 | XVI | 650 right | | 1008–9 | XVI |
| Binder | 26 | XXII | | | 1003–4 | |
| Support | 28 | XVII | | | 1009 | XVII |

As a support used in the light-sensitive material of the present invention, those described in the above-mentioned RD are cited. As a suitable support, a plastic film is cited. On the surface of such a support, a subbing layer, corona discharge for UV irradiation may be provided for the better adhesion of coating layer. The emulsion used in the invention can be provided on both surfaces of the support. The light sensitive material in the invention comprises optionally an anti-halation layer, an intermediate layer or a filter layer.

In the invention, a silver halide emulsion layer or another hydrophilic colloid layer may be provided on s support or another layer according to various coating methods. The methods include a dip coating method, a roller coating method, a curtain coating method, an extrusion coating method, or a slide hopper coating method. The methods are detailed in RD, Volume 176, p. 27-18, Item "Coating Procedures".

The light sensitive material in the invention can be processed with a processing solution described in the above described RD-17643, XX–XXI, p. 29–30 or RD-308119, XX–XXI, p. 1011–1012.

The developing agent in the black and white photographic material includes dihydroxybenzenes (for example, hydroquinone), 3-pyrazolidones (for example, 1-phenyl-3-pyrazolidone), and aminophenols (for example, N-methylaminophenol). The agent can be used singly or in combination. The developer optionally contains conventional additives such as a preserver, an alkali agent, a pH-buffering agent, an anti-foggant, a hardener, a developing accelerator, a surfactant, an anti-foaming agent, a toning agent, a water softening agent, a dissolution auxiliary, or a thickener.

The fixer contains a fixing agent such as a thiosulfate or a thiocyanate, and optionally further contains a water soluble aluminum salt, such as aluminum sulfate or potassium alum. Besides the above compounds, the fixer optionally contains a preservative, a pH regulating agent or a water softening agent.

In the invention, light sensitive material can be rapidly processed in a total processing time (Dry to Dry) of 10 to 30 seconds. In the invention, the developing time refers to the time from when a leading edge of light sensitive material enters into a developer in the developing tank until the edge enters into a fixer in the next fixing tank, the fixing time refers to the time from when the edge enters into the fixer until the edge enters into a washing water in the next washing tank, and the washing time refers to the time while the light sensitive material is immersed in the washing water. The drying time refers to the time the material passes a drying zone in which hot air of 35° to 100° C., preferably 40° to 80° C. is supplied.

In the invention, processing such as developing or fixing is carried out at 25° to 50° C. in 15 seconds or less, and preferably at 30° to 40° C. in 2 to 10 seconds.

In the invention, the developed, fixed, and washed (or stabilized) light sensitive material passes through squeegeeing rollers whereby the water is removed, and then dried. Washing is preferably carried out at 5° to 50° C. in 2 to 10 seconds.

In the invention, the developed, fixed, and washed light sensitive material passes through squeegeeing rollers, and then dried. Drying can be carried out using a hot air, an infrared heater, a heat roller or their combination, and is preferably carried out at 40° to 100° C. in 4 to 15 seconds.

In the invention, developer replenisher or fixer replenisher is replenished in an amount of 35 to 130 ml per $m^2$ of light sensitive material to be processed. The replenishing method includes a method employing width and transporting speed of light sensitive material as disclosed in JP-A 55-1126243, a method employing an area of light sensitive material to have been processed as disclosed in JP-A 60-104946, and a method employing a controlled processing area of light sensitive material to have been processed as disclosed in JP-A 1-149156.

EXAMPLES

The examples of the invention will be explained below, but the invention is not limited thereto.

Example 1

A seed emulsion and silver halide emulsion used in the examples were prepared as follows.

(Preparation of Seed Emulsion-1)

| | |
|---|---|
| A 1 | |
| Ossein gelatin | 24.2 g |
| Water | 9657 ml |
| Polypropyleneoxy-polyethyleneoxy-disuccinate sodium salt (10% ethanol solution) | 6.78 ml |
| Potassium bromide | 10.8 g |
| 10% nitric acid | 114 ml |
| B 1 | |
| Aqueous 2.5N $AgNO_3$ solution | 2825 ml |
| C 1 | |
| Potassium bromide | 824 g |
| Potassium iodide | 23.5 g |
| Water was added to make 2825 ml. | |
| <Solution D> | |
| Aqueous 1.75N KBr solution | an amount for controlling the following silver potential |

By the use of a mixing stirrer described in Japanese Patent Publication Nos. 58288/1983 and 58289/1982, 464.3 ml of each of Solution B 1 and Solution C 1 were added to Solution A 1 in 1.5 minutes at 35° C. by a double-jet method to form a nuclei.

After addition of Solutions B 1 and C 1 was stopped, the temperature of Solution A 1 was elevated to 60° C. spending 60 minutes and adjusted to pH 5.0 using a 3% KOH solution. Then, solutions B 1 and C 1 each were added by means of a double jet method for 42 minutes at a flow rate of 55.4 ml/min. The silver potentials (measured by means of a silver ion selecting electrode and a saturated silver-silver chloride reference electrode) during the temperature elevation from 35° to 60° C. and during the re-addition of solutions B-1 and C-1 were regulated to +8 mv and 16 mv, respectively, using Solution D 1.

After the addition, pH was regulated to 6 with 3% KOH. Immediately after that, it was subjected to desalting and washing. It was observed by an electron microscope that this seed emulsion was composed of hexahedral tabular grains, in which 90% or more of the total projected area of silver halide grains have a maximum adjacent side ratio of 1.0 to 2.0, having an average thickness of 0.06 μm, an average grain size (converted to a circle) of 0.59 μm. The deviation coefficient of the thickness is 40%, and the deviation coefficient of the distance between the twin planes is 42%.

(Preparation of Em-1)

The tabular silver halide emulsion Em-1 having a core/shell structure was prepared using the seed emulsion-1 and the following five kinds of solutions.

| | |
|---|---|
| A 2 | |
| Ossein gelatin | 11.7 g |
| Polypropyleneoxy-polyethyleneoxy-disuccinate sodium salt (10% ethanol solution) | 1.4 ml |
| Seed emulsion-1 | amount equivalent to 0.10 mol |
| Water was added to make 550 ml. | |
| B 2 | |
| Ossein gelatin | 5.9 g |
| Potassium bromide | 6.2 g |
| Potassium iodide | 0.8 g |

-continued

| | |
|---|---|
| Water was added to make 145 ml. | |
| C 2 | |
| Silver nitrate | 10.1 g |
| Water was added to make 145 ml. | |
| D 2 | |
| Ossein gelatin | 6.1 g |
| Potassium bromide | 94 g |
| Water was added to make 304 ml. | |
| E 2 | |
| Silver nitrate | 137 g |
| Water was added to make 304 ml. | |

Solution B2 and Solution C2 were added by a double-jet method to Solution A2 in 58 minutes at 67° C. with vigorous stirring. Thereafter, Solution D2 and Solution E2 were added thereto by a double-jet method in 48 minutes. During this process, pH was maintained 5.8, and pAg 8.7.

After the addition, the resulting emulsion was subjected to desalting and washing in the same manner as in seed emulsion-1, and was adjusted at 40° C. to give pAg of 8.5 and pH of 5.85. Thus, Emulsion Em-1 having a silver iodide content of 0.5 mol % was obtained.

When the resulting emulsion was observed by means of an electron microscope, it contained tabular silver halide grains having an average grain size of 0.96 μm, a grain size distribution of 19% and an average aspect ratio of 4.5. The average of the distance (a) between the twin planes was 0.019 μm, and a variation coefficient of (a) was 28%.

(Preparation of Seed Emulsion-2)

| Seed emulsion-2 was prepared as follows. | |
|---|---|
| A 4 | |
| Ossein gelatin | 100 g |
| Potassium bromide | 2.05 g |
| Water was added to make 11.5 liters. | |
| B 4 | |
| Ossein gelatin | 55 g |
| Potassium bromide | 65 g |
| Potassium iodide | 1.8 g |
| 0.2N sulfuric acid | 38.5 ml |
| Water was added to make 2.6 liters. | |
| C 4 | |
| Ossein gelatin | 75 g |
| Potassium bromide | 950 g |
| Potassium iodide | 27 g |
| Water was added to make 3.0 liters. | |
| D 3 | |
| Silver nitrate | 95 g |
| Water was added to make 2.7 liters. | |
| E 2 | |
| Silver nitrate | 1410 g |
| Water was added to make 3.2 liters. | |

Solution B4 and Solution D3 were added at 67° C. in 30 minutes by a double-jet method to Solution A4 in a reaction vessel. Thereafter, Solution C4 and Solution E2 were added thereto by a double-jet method in 105 minutes. Stirring was carried out at 500 rpm.

The addition was carried out at such a rate that does not produce new nuclei, and does not cause Ostwald ripening and broaden the grain size distribution. When a silver ion solution and a halide ion solution were added, pAg was adjusted to 8.3±0.05 using a potassium bromide solution, and pH was adjusted to 2.0±0.1 using a sulfuric acid solution.

After the addition, the emulsion was adjusted to pH of 6.0, and desalted by a method disclosed in JP-B35-16086 in order to remove the excessive salt.

When the resulting emulsion was observed by means of an electron microscope, it contained monodispersed cubic tetradecahedral silver halide grains with chanfered corners having an average grain size of 0.27 μm, and a grain size distribution of 17%.

Preparation of Em-2

The monodispered core/shell emulsion was prepared using the seed emulsion-2 and the following seven kinds of solutions.

| | |
|---|---|
| A 5 | |
| Ossein gelatin | 10 g |
| Aqueous ammonia (28%) | 28 ml |
| Glacial acetic acid | 3 ml |
| Seed emulsion-2 | amount equivalent to 0.119 mol |
| Water was added to make 600 ml. | |
| B 5 | |
| Ossein gelatin | 0.8 g |
| Potassium bromide | 5 g |
| Potassium iodide | 3 g |
| Water was added to make 110 ml. | |
| C 5 | |
| Ossein gelatin | 2.0 g |
| Potassium bromide | 90 g |
| Water was added to make 240 ml. | |
| D 4 | |
| Silver nitrate | 9.9 g |
| Aqueous ammonia (28%) | 7.0 ml |
| Water was added to make 110 ml. | |
| E 3 | |
| Silver nitrate | 130 g |
| Aqueous ammonia (28%) | 100 ml |
| Water was added to make 240 ml. | |
| F 1 | |
| Potassium bromide | 94 g |
| Water was added to make 165 ml. | |
| G 1 | |
| Silver nitrate | 9.9 g |
| Aqueous ammonia (28%) | 7.0 ml |
| Water was added to make 110 ml. | |

Solution A5 was maintained at 40° C. and stirred at 800 rpm using a stirrer. The solution A5 was adjusted to pH 9.90 and Solution G1 was added thereto at a constant rate in 7 minutes and then was adjusted to pAg 7.3. Thereafter, Solutions B5 and D4 were simultaneously added in 20 minutes maintaining pAg 7.3. The resulting emulsion was adjusted to pH 8.83 and pAg 9.0 using an acetic acid solution and a potassium bromide solution, and then Solutions C5 and E3 were simultaneously added in 30 minutes.

In the above process, the ratio of the addition amount at the beginning of additon to that at completion of addition is 1:10, in which the addition amount was increased with time. The pH was lowered from 8.83 to 8.00 in proportion to the ratio. When ⅔ of each of Solution C5 and E3 were added, F1 was added at a constant rate in 8 minutes during which pAg was elevated from 9.0 to 11.0. The resulting emulsion was adjusted to pH 6.0 usig an acetic acid solution.

Thereafter, the emulsion was processed in the same manner as in Em-1 to obtain a monodispersed core/shell emulsion containing tetradecahedral rounded silver halide grains having an average silver iodide content of 2 mol %, an average grain size of 0.40 μm, a grain size distribution of 14% and an average aspect rationof 1.2. Thus, Emulsion Em-2 was obtained.

After each of the resulting emulsions (Em-1 and Em-2) was raised to 60° C., a spectral sensitizer was added in a specific amount in the form of a solid fine particle dispersion, and an aqueous mixture solution of adenine, ammonium thiocyanate, chloroauric acid and sodium thiosulfate and a methyl acetate-methanol solution of triphenylphosphin selenide were added. Sixty minutes after the addition, the fine grain silver iodide emulsion was added, and the emulsion was ripened for total 2 hours. After completion of the ripening, 4-hydroxy-6-methyl-1,3,3a,7-tetrazaindene (TAI) was added for stabilizing.

The addition amount per mol of AgX of the above additives is shown as follows:

| | |
|---|---|
| Spectral sensitizer (A) | 120 mg |
| Spectral sensitizer (B) | 2 mg |
| Adenine | 15 mg |
| Potassium thiocyanide | 95 mg |
| Chloroauric acid | 2.5 mg |
| Sodium thiosulfate | 2.0 mg |
| Triphenylphosphin selenide | 0.4 mg |
| Silver iodide fine grain emulsion | 280 mg |
| 4-Hydroxy-6-methyl-1,3,3a,7-tetrazaindene (TAI) | 50 mg |

The solid fine particle dispersion of the spectral sensitizing dye was prepared according to the method described in Japanese Patent O.P.I. Publication No. 5-297496. A specific amount of a spectral sensitizer was added to water at 27° C., and stirred at 3500 rpm for 30 tO 120 minutes by means of a high speed stirrer (dissolver) to obtain a solid spectral sensitizing dye fine particle dispersion.

Spectral sensitizer (A): 5,5'-Dichloro-9-ethyl-3,3'-di-(sodiumsulfopropyl)-oxacarbocianine sodium salt anhydride Spectral sensitizer (B): 5,5'-Di(butoxycarbonyl)-1,1'-diethyl-3,3'-di-(4-sulfobutyl)-benzoimidazolocarbocianine sodium salt anhydride The following light shielding layer, silver halide emulsion layer and protective layer were simultaneously coated in that order on each side of a sub-layered, blue colored, 175 μm thick polyethylene terephthalate film support, and dried.

(Preparation of Light Sensitive Material Sample)

| First Layer (Light Shielding Layer) | |
|---|---|
| Solid dye fine particle dispersion (AH) | 50 mg/m² |
| Gelatin | 0.4 g/m² |
| Sodium dedecylbenzene sulfonate | 5 mg/m² |
| Compound (I) | 5 mg/m² |
| 2,4-Dichloro-6-hydroxy-1,3,5-triazine sodium salt | 5 mg/m² |
| Colloidal Silica (average diameter 0.014 μm) | 10 mg/m² |
| Latex (L) | 0.2 g/m² |
| Poly(potassium styrenesulfonate) | 50 mg/m² |
| Second Layer (Emulsion Layer) | |

Each emulsion obtained above was added with the following additives.

| | |
|---|---|
| Potassium palladium (II) tetrachloride | 100 mg/m² |
| Compound (G) | 0.5 mg/m² |
| 2,6-Bis(hydroxyamino)-4-diethylamino-1,3,5-triazine | 5 mg/m² |
| t-Butyl-catechol | 130 mg/m² |

-continued

| | |
|---|---|
| Polyvinyl pyrrolidone (molecular weight 10,000) | 35 mg/m² |
| styrene-maleic acid anhydride copolymer | 80 mg/m² |
| Poly(sodium styrenesulfonate) | 80 mg/m² |
| Trimethylolpropane | 350 mg/m² |
| Diethylene glycol | 50 mg/m² |
| Nitrophenyl-triphenyl phosphonium chloride | 20 mg/m² |
| Ammonium 1,3-dihydroxybenzene-4-sulfonic acid | 500 mg/m² |
| Sodium 2-mercaptobenzimidazole-5-sulfonate | 5 mg/m² |
| Compound (H) | 0.5 mg/m² |
| $n\text{-}C_4H_9OCH_2CH(OH)CH_2N(CH_2COOH)_2$ | 350 mg/m² |
| Compound (M) | 5 mg/m² |
| Compound (N) | 5 mg/m² |
| Tabular silica particles in the invention | an amount shown in Table 1 |
| Latex (L) | 0.4 g/m² |
| Dextrin (average molecular weight 1000) | 0.2 g/m² |
| The gelatin content was adjusted as shown in Table 1. | |
| Third Layer (Protective Layer) | |
| Gelatin | 0.8 g/m² |
| 4-Hydroxy-6-methyl-1,3,3a,7-tetrazaindene | 50 mg |
| Polymethylmethacrylate matting agent having an area average grain size of 7 μm | 50 mg/m² |
| Colloidal silica (average particle size of 0.014 μm) | 10 mg/m² |
| Formaldehyde | 20 mg/m² |
| 2,4-Dichloro-6-hydroxy-1,3,5-triazine sodium salt | 10 mg/m² |
| Bis-vinylsulfonylmethyl ether | 36 mg/m² |
| Latex (L) | 0.2 g/m² |
| Polyacrylamide (molecular weight 10,000) | 0.1 g/m² |
| Polysodium acrylate | 30 mg/m² |
| Compound (SI) | 20 mg/m² |
| Compound (I) | 12 mg/m² |
| Compound (J) | 2 mg/m² |
| Compound (S-1) | 7 mg/m² |
| Compound (K) | 15 mg/m² |
| Compound (O) | 50 mg/m² |
| Compound (S-2) | 5 mg/m² |
| Compound (F-1) | 3 mg/m² |
| Compound (F-2) | 2 mg/m² |
| Compound (F-3) | 1 mg/m² |

The amount was per one side of the support, and the silver amount was 1.6 g/m² per one side of the support.

Latex (L)

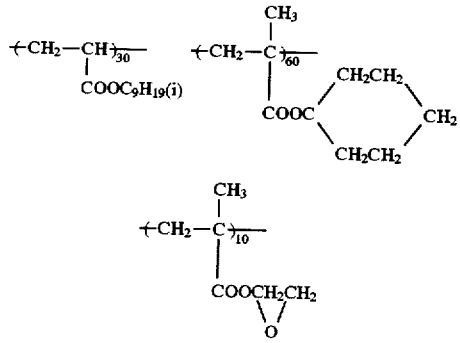

Compound (I)

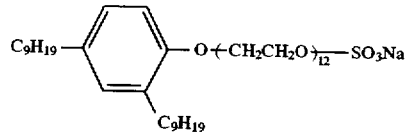

-continued

Compound (G)

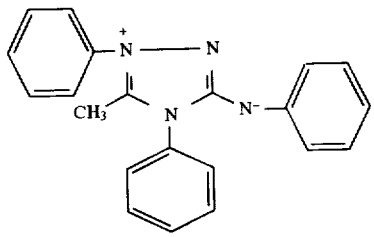

Compound (H)

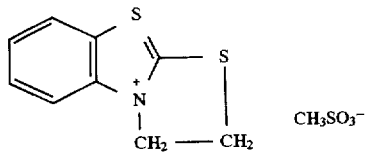

Solid fine particle dispersion dye (AH)

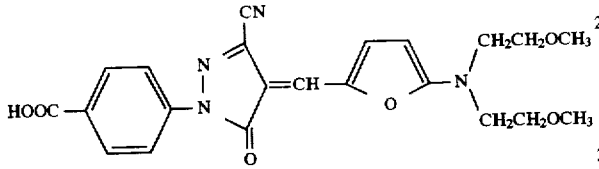

Compound (M)

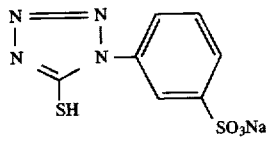

Compound (N)

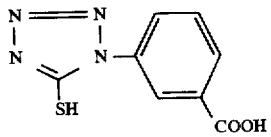

Compound (J)

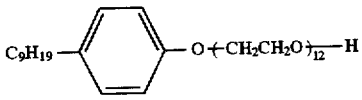

Compound (S1)

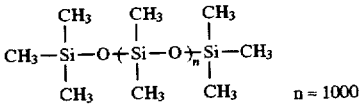

Compound (S-1)

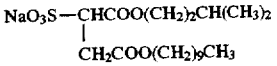

-continued

Compound (K)

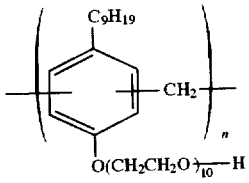

(a mixture of n = 2 to 5)

Compound (O)

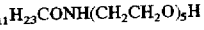

Compound (S-2)

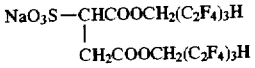

Compound (F-1)

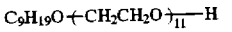

Compound (F-2)

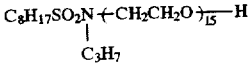

Compound (F-3)

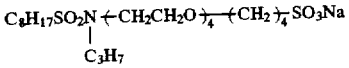

1) Evaluation of Pressure Resistance

The above obtained sample was allowed to stand at 23° C. and 40% RH for 2 hours. The resulting sample was scratched with a sapphire needle with a diameter of 0.1 mm with a 0 to 200 g load applied employing a scratch meter HEIDON-18 TYPE produced by Shinto Kagaku Co., Ltd., and then processed according to the following processing conditions. The load to give a density of fog plus 0.1 was measured. The greater the load value, the higher the pressure resistance.

| Processing Conditions | | |
|---|---|---|
| Development | 38° C. | 7.0 seconds |
| Fixing | 37° C. | 4.0 seconds |
| Washing | 26° C. | 7.0 seconds |
| Squeegeeing | | 2.4 seconds |
| Drying | 58° C. | 4.0 seconds |
| Sum (Dry to Dry) | | 24.4 seconds |

Developer composition

| Part A (for 12 liter) | |
|---|---|
| Potassium hydroxide | 450 g |
| Potassium sulfite (50% solution) | 2280 g |
| Diethylene tetramine pentaacetate | 120 g |
| Sodium bicarbonate | 132 g |
| 5-Methylbenzotriazole | 1.2 g |
| 1-Phenyl-5-mercaptotetrazole | 0.2 g |
| Hydroquinone | 340 g |
| Water was added to 5000 ml. | |

| Part B (for 12 liter) | |
|---|---|
| Glacial acetic acid | 170 g |
| Triethylene glycol | 185 g |
| 1-Phenyl-3-pyrazolidone | 22 g |
| 5-Nitroindazole | 0.4 g |

-continued

| Starter | |
|---|---|
| Glacial acetic acid | 120 g |
| Potassium bromide | 225 g |
| Water was added to 1 liter. | |

Parts A and B of the developer composition were simultaneously incorporated in 5 liter water while stirring and water was added to make 12 liters. The resulting solution was adjusted to pH 10.40 with glacial acetic acid. Thus, Developer replenisher was prepared.

To 1 liter of the developer replenisher were added 20 ml/liter of the starter described above and pH was adjusted to 10.40. Thus, developer to be used was obtained.

Fixer Composition

| Part A (for 18 liters) | |
|---|---|
| Ammonium thiosulfate (70 wt/vo %) | 6000 g |
| Sodium sulfite | 110 g |
| Sodium acetate·trihydrate | 450 g |
| Sodium citrate | 50 g |
| Gluconic acid | 70 g |
| 1-(N,N-dimethylamino)ethyl-5-mercaptotetrazole | 18 g |
| Part B | |
| Aluminum sulfate | 800 g |

Parts A and B of the fixer composition was simultaneously incorporated in 5 liter water while stirring and water was added to make 18 liters. The resulting solution was adjusted to pH 4.4 with sulfuric acid and NaOH. Thus, fixer or fixer replenisher was prepared.

2) Evaluation of Devitrification

The above obtained sample was cut into 300×250 mm, and the unexposed sample was development processed in the same manner as above. Haze of the processed sample was measured for devitrification, employing a turbidity meter T-2600DA produced by Tokyo Denshoku Gijutsu Center.

The results are shown in Table 1.

TABLE 1

| Sample No. | Kind of Emulsion | Total Gelatin Content of Emulsion Layer (g/m²) | Dispersion used Kind | Dispersion used (g/m²)[1] | Pressure resistance (g) | Haze (%) | Remarks |
|---|---|---|---|---|---|---|---|
| 1 | Em-1 | 1.45 | — | — | 56 | 10.2 | Comparative |
| 2 | Em-1 | 1.45 | Comp. a* | 0.5 | 151 | 19.2 | Comparative |
| 3 | Em-1 | 1.10 | Comp. a* | 0.5 | 123 | 25.2 | Comparative |
| 4 | Em-1 | 1.45 | Comp. b** | 0.5 | 150 | 20.3 | Comparative |
| 5 | Em-1 | 1.45 | B-1 | 0.5 | 171 | 10.1 | Invention |
| 6 | Em-1 | 1.45 | B-2 | 0.5 | 168 | 9.9 | Invention |
| 7 | Em-1 | 1.45 | B-3 | 0.5 | 165 | 10.3 | Invention |
| 8 | Em-1 | 1.45 | B-4 | 0.5 | 165 | 10.4 | Invention |
| 9 | Em-1 | 1.45 | B-5 | 0.5 | 169 | 10.9 | Invention |
| 10 | Em-1 | 1.45 | B-6 | 0.5 | 168 | 11.0 | Invention |
| 11 | Em-1 | 1.10 | B-1 | 0.5 | 161 | 10.6 | Invention |
| 12 | Em-1 | 0.50 | B-1 | 0.5 | 149 | 10.2 | Invention |
| 13 | Em-1 | 1.60 | B-1 | 0.5 | 185 | 10.9 | Invention |
| 14 | Em-1 | 1.45 | B-1 | 0.3 | 162 | 9.2 | Invention |
| 15 | Em-1 | 1.45 | B-1 | 0.8 | 186 | 11.5 | Invention |
| 16 | Em-2 | 1.45 | B-1 | 0.5 | 175 | 10.8 | Invention |
| 17 | Em-2 | 1.45 | B-1 | 0.3 | 168 | 9.4 | Invention |

* Comp. a: Lucentite SWN produced by Cope Chemical Co., Ltd.
** Comp. b: Lucentite SWF produced by Cope Chemical Co., Ltd.
[1]Coating amount of tabular silica particles as a solid.

As is apparent from Table 1, the inventive samples exhibit superior pressure resistance and less devitrification as compared with comparative samples.

What is claimed is:

1. A silver halide photographic light sensitive material comprising a support and provided thereon, a light sensitive silver halide emulsion layer and a non-light sensitive hydrophilic binder layer, wherein at least one of the light sensitive silver halide emulsion layer and the non-light sensitive hydrophilic binder layer contains tabular silica particles covered with a hardened gelatin.

2. The silver halide photographic light sensitive material of claim 1, wherein the tabular silica particles have an average particle size of 2 to 300 nm and an aspect ratio of 2 to 100, and the tabular silica particle content of the total silica particles is 50 weight % or more.

3. The silver halide photographic light sensitive material of claim 1, wherein each of the light sensitive silver halide emulsion layer and the non-light sensitive hydrophilic binder layer contains gelatin.

4. The silver halide photographic light sensitive material of claim 3, wherein the total gelatin content of a layer containing the tabular silica particles is 0.2 to 1.5 g/m², and the tabular silica particle content (by weight) of said layer is 0.05 to 1.0 based on the total gelatin content.

5. The silver halide photographic light sensitive material of claim 1, wherein the light sensitive silver halide emulsion layer contains the tabular silica particles.

6. The silver halide photographic light sensitive material of claim 5, wherein the light sensitive silver halide emulsion layer contains tabular silver halide grains having an aspect ratio of 3 to 15.

7. The silver halide photographic light sensitive material of claim 1, wherein the hardened gelatin is formed by hardening gelatin with a hardener.

8. A silver halide photographic light sensitive material comprising a support and provided thereon, a light sensitive silver halide emulsion layer and a non-light sensitive hydrophilic binder layer, each layer containing gelatin, wherein at least one of the light sensitive silver halide emulsion layer and the non-light sensitive hydrophilic binder layer contains tabular silica particles covered with hardened gelatin, the tabular silica particles having an average particle size of 1 to 300 nm and an aspect ratio of 2 to 100, and the tabular silica particle content of the total silica particles being 50 weight % or more, and the total gelatin content of a layer containing the tabular silica particles is 0.2 to 1.5 g/m$^2$, and the tabular silica particle content (by weight) of the layer containing the tabular silica particles is 0.05 to 1.0 based on the total gelatin content.

9. A silver halide photographic light sensitive material comprising a support and provided thereon, a light sensitive silver halide emulsion layer containing gelatin and tabular silica particles covered with hardened gelatin, the tabular silica particles having an average particle size of 1 to 300 nm and an aspect ratio of 2 to 100, and the tabular silica particle content of the total silica particles being 50 weight % or more, wherein the total gelatin content of the emulsion layer is 0.2 to 1.5 g/m$^2$, and the tabular silica particle content of the emulsion layer is 0.05 to 1.0 based on the total gelatin content.

* * * * *